US008282748B2

(12) United States Patent
Moll et al.

(10) Patent No.: US 8,282,748 B2
(45) Date of Patent: Oct. 9, 2012

(54) PROCESS FOR PRODUCING METAL MATRIX COMPOSITE MATERIALS

(75) Inventors: Florian Moll, Sassenburg (DE); Lutz Oemisch, Wolfsburg (DE); Ulrich Bischofberger, Esslingen (DE); Karl Ulrich Kainer, Hohnstorf (DE); Norbert Hort, Lueneburg (DE); Hajo Dieringa, Südergellersen (DE); Hagen Frank, Winsen/Luhe (DE)

(73) Assignee: Mahle GmbH, Stuttgart (DE)

( * ) Notice: Subject to any disclaimer, the term of this patent is extended or adjusted under 35 U.S.C. 154(b) by 1303 days.

(21) Appl. No.: 10/577,914

(22) PCT Filed: Oct. 16, 2004

(86) PCT No.: PCT/EP2004/011688

§ 371 (c)(1),
(2), (4) Date: Dec. 18, 2006

(87) PCT Pub. No.: WO2005/046911

PCT Pub. Date: May 26, 2005

(65) Prior Publication Data

US 2007/0104606 A1 May 10, 2007

(30) Foreign Application Priority Data

Nov. 7, 2003 (DE) ..... 103 52 453

(51) Int. Cl.

| | |
|---|---|
| ***C22F 1/06*** | (2006.01) |
| *C22C 23/00* | (2006.01) |
| *C22C 1/04* | (2006.01) |

(52) U.S. Cl. ..... 148/667; 419/10; 420/402

(58) Field of Classification Search ..... 148/667; 420/402

See application file for complete search history.

(56) References Cited

U.S. PATENT DOCUMENTS

| | | | | |
|---|---|---|---|---|
| 3,415,697 | A * | 12/1968 | Bredzs et al. | 228/234.3 |
| 5,902,424 | A * | 5/1999 | Fujita et al. | 148/667 |
| 2005/0089435 | A1 * | 4/2005 | Kondoh | 419/19 |

FOREIGN PATENT DOCUMENTS

| | | | |
|---|---|---|---|
| EP | 0 478 025 | | 4/1992 |
| EP | 0 773 302 | | 5/1997 |
| EP | 1 281 459 | | 2/2003 |
| EP | 1 433 862 | | 6/2004 |
| JP | 04-231168 | | 8/1992 |
| JP | 04-263037 | | 9/1992 |
| JP | 06081068 | | 3/1994 |
| JP | 09-104933 | | 4/1997 |
| JP | 2000-017352 | | 1/2000 |
| JP | 2003-211260 | | 7/2003 |
| WO | WO 03/027341 | | 4/2003 |
| WO | WO 03/027342 | | 4/2003 |
| WO | WO/03069001 | * | 8/2003 |

* cited by examiner

*Primary Examiner* — Kiley Stoner
*Assistant Examiner* — Alexander Polyansky
(74) *Attorney, Agent, or Firm* — Welsh Flaxman & Gitler LLC

(57) ABSTRACT

The invention relates to a method for producing metal matrix composite materials, including at least one proportion of magnesium or one magnesium alloy and involving at least one production step in which a thixomolding ensues. According to the invention, an $Mg_2Si$ phase having a volume fraction of at least 2% is incorporated in a metal matrix preferably comprised of magnesium or of a magnesium alloy. The inventive method uses the thixomolding method for the in-situ production of a metallic composite material and is advantageous in that a broad range of adjustable volume fractions of the $Mg_2Si$ phase in the composite material results whereby enabling the properties of the composite material to be individually modified. The inventive metal matrix composite material is particularly suited for producing thermally stressed parts of motor vehicles such as pistons or the like.

9 Claims, No Drawings

PROCESS FOR PRODUCING METAL MATRIX COMPOSITE MATERIALS

BACKGROUND OF THE INVENTION

The invention relates to a process for producing metal-matrix composite materials made up of at least one portion of magnesium or of a magnesium alloy and at least one production step in which thixomolding takes place.

The material magnesium, due to its low elastic modulus, high coefficient of thermal expansion, and lack of wear resistance, cannot be easily used for certain applications, such as for pistons in motor vehicle engines or other assembly components, especially of engines. The indicated properties can however be beneficially influenced by the material being reinforced by means of a second, usually much more solid, and harder phase. Ordinarily ceramic or carbon-based short or long fibers or particles are used for this purpose. They can be infiltrated in melting metallurgical production, either in the form of a porous mold body (so-called preform) which is infiltrated with the liquid metal melt, or in the case of particles, added also by stirring into the metallic matrix. Another possibility for reinforcing a metallic material by fibers or particles consists in self-formation or also "in-situ" formation of the reinforcing component. In addition to the indicated melting metallurgical processes, metallic composite materials can also be produced by powder metallurgy.

When using preforms as the infiltratable mold bodies, squeeze casing has been established as the preferred casting process. In this connection, at somewhat lower mold filling speeds, but at somewhat higher pressures than in classical die casting, the molten metal is squeezed into the porous fiber or particle bodies. An almost pore-free composite material with closed fiber-matrix linkages is produced.

When stirring in, ordinarily ceramic particles as loose charge material are supplied to the moving metal melts by trickling or blowing in. Composite material melts of this type can be cast in the form of castings or bars. In the in-situ process the composite material is formed by a reaction between two or more alloying elements of the metallic matrix or phases of the overall system, generally with the formation of a new, generally intermetallic phase.

Production and characterization of the Mg—$Mg_2Si$ system have been repeatedly described. Reference is made for example to the disclosure of DE 41 25 014 A1. The formation of an intermetallic phase for the purpose of reinforcing can be assigned to the in-situ process. Generally this takes place by infiltration of Si particle-containing fiber preforms or by precipitation of primary magnesium silicides from hypereutectic Mg—Si alloys. While coarse, block-shaped $Mg_2Si$ precipitations form during primary precipitations after falling below the liquidus line, the $Mg_2Si$ in the reactive conversion of pure Si in a preform spheroidizes globally. Eutectically precipitated $Mg_2Si$ in turn generally shows the characteristic "Chinese script" structure.

DE 101 35 198 A1 describes a process for producing magnesium alloys by thixomolding, which alloys in addition to other elements can also contain a portion of silicon.

In the thixomolding process the metallic material is supplied as a granulate to the thixomolding machine and moved in the direction of the spray diffuser within the heated cylinder by a screw conveyor. Under the action of shear forces and the temperature which is between the liquidus temperature and the solidus temperature of the metal, it partially liquefies, while the remaining solid portion spheroidizes globally. The behavior of the thixotropic material is structurally viscous. i.e. the viscosity decreases with increasing shear action.

Thixomolding is suitable especially for producing very thin-walled components with high dimensional stability, since as a result of the favorable temperature level between the liquidus line and solidus line hardly any shrinkage and warping phenomena occur.

The disadvantages of the aforementioned process routes for producing metallic composite materials in the case of preform infiltration lies in the complex plant technology, limited shaping capacity, fiber content of the preforms, and its high cost level. Complex geometries at present can hardly be accomplished or only at increased technical input and financial cost, so that net shape production of fiber- or particle-reinforced components by infiltration is hardly possible at present. This generally results in relatively high working effort which in use of ceramic hard phases as reinforcement is difficult and costly, since for example working of a body reinforced with SiC fibers or $Al_2O_3$ fibers is possible only by means of diamond-coated tools. Moreover the infiltration capacity of preforms with high fiber and particle content in a classic die casting is not easily given, preferably the squeeze casting process is used for this purpose, for which in turn special casting systems are necessary. The difficulties which can arise in infiltration by means of die casting are caused predominantly by the high filling rate of the process and the low pressure which can be applied over the melt as a result of the small gate. But this is necessary to overcome the normally very low wetting tendency between the metallic melt and the ceramic mold body. In addition, the preform must be heated distinctly above the melting point in order to avoid premature solidification of the melt on the fiber body.

The process of stirring-in is reserved first of all to the particulate reinforcements, since the use of fibers can lead to a major increase of melt viscosity which makes a uniform distribution of the fibers very difficult or even impossible. In the case of particles, the stirrer result is dependent on the particle size used, the stirrer rpm and the temperature. Inadequate parameter selection can lead to agglutination, scouring of particles into the slag, or their sedimentation on the crucible bottom. If the particles and melts are a reactive system, under certain circumstances due to the long contact time between the two phases conversion reactions on the interfaces occur, which result in damage to the particles. An example of this is for instance the magnesium/aluminum oxide system, here magnesium oxide and aluminum are formed in the reaction between the two partners with the decomposition of the particle substance.

It is an object of this invention is to make available a process for producing metal matrix composite materials of the initially mentioned type, which enables production of lightweight metal composite materials especially for use in temperature-stressed components, which is more variable and economical than the existing processes and avoids the disadvantages associated with them.

SUMMARY OF THE INVENTION

The lightweight metal composite material is produced in the thixomolding process, a $Mg_2Si$ phase with a volumetric content of at least 2% being dispersed into the matrix.

The special advantages of the process arise from the combination of the thixomolding process with the process for in-situ production of a metallic composite material. Mg—$Mg_2$—Si composite materials with a volumetric content of at least 2% $Mg_2Si$ will be produced, preferably by a granulate of silicon or of a silicon alloy and a granulate of magnesium or of a magnesium alloy being supplied jointly to the thixomolding process and with shearing there forming an at least partially liquid melt which solidifies in the form of a magnesium body. Advantages of the process are the wide range of variation of the adjustable volumetric contents of $Mg_2Si$, the possibility of being able to abandon fiber and particle preforms, and being able to determine the quantity and size of the forming $Mg_2Si$ crystals by way of the size and quantity of Si particles, by which in turn properties such as the coefficient of thermal expansion, the elastic modulus, the tensile and elongation limit and the wear behavior can be individually changed. Thus Si contents which cannot be produced by melting metallurgy can be set. The material which has been cast in this way can be supplied to subsequent forming operations, such as for example forging processes.

Preferably in the thixomolding process a cast body is produced from the metal-matrix composite material which is then further processed. In particular, the cast body is then formed in at least one process step. This forming process can include at least one forging process.

The subject matter of this invention is furthermore metal-matrix composite materials which have been produced using the process as outlined in the invention.

The subject matter of this invention is furthermore the use of metal-matrix composite materials which have been produced using a process for producing components for motor vehicles. Preferably they are motor vehicle components of lightweight metal composite materials which are exposed to high temperature stresses, for example engine components such as pistons and the like.

Other advantages of the invention will become apparent from the following detailed description.

DETAILED DESCRIPTION OF THE INVENTION

Metal-matrix composite materials which have been produced using the process as claimed in the invention can be used for example to produce pistons or other engine components for diesel or gasoline engines. The metal-matrix composite materials are furthermore suited for example for producing bushings for shafts, cylinders and other rotationally symmetrical parts, especially in engines. They are furthermore suited for producing other wear-stressed motor vehicle parts, such as for example brake disks.

The volumetric content of the $Mg_2Si$ phase in the metal matrix is preferably in the range between roughly 5 and roughly 40% by volume. The metal-matrix composite materials as claimed in the invention can be obtained for example proceeding from standard alloys such as AZ91, AM50, MR1230D, MR1253M or other magnesium die casting alloys to which Si is added. The reaction $2\,Mg+Si \rightarrow Mg_2Si$ is important here. Within the framework of the invention, addition of at least roughly 2 percent by weight Si and preferably a maximum of roughly 15 percent by weight Si is possible. The resulting percentages by volume of $Mg_2Si$ are listed in the following Table 1, which shows sample proportions of the $Mg_2Si$ phase in the metal-matrix composite material.

TABLE 1

| Amounts of Si added in % by weight and resulting amounts in percent by volume | |
|---|---|
| % by weight Si | % by volume $Mg_2Si$ |
| 2 | 5.08 |
| 3 | 7.63 |
| 4 | 10.19 |
| 5 | 12.77 |
| 6 | 15.35 |

TABLE 1-continued

| Amounts of Si added in % by weight and resulting amounts in percent by volume | |
|---|---|
| % by weight Si | % by volume $Mg_2Si$ |
| 7 | 17.95 |
| 8 | 20.55 |
| 9 | 23.17 |
| 10 | 25.80 |
| 11 | 28.44 |
| 12 | 31.09 |
| 13 | 33.75 |
| 14 | 36.42 |
| 15 | 39.10 |

$Mg_2Si$ is a comparatively high-melting phase with a melting point near 1100° C. Thus this phase is suited as reinforcement for improving the high temperature properties of the matrix material. This relates both to the creep behavior and also characteristics such as thermal conductivity and also coefficients of thermal expansion. In addition to other physical and mechanical properties, these values can be set specifically with respect to an application. The exact numerical values depend among others both on the base alloy, the volumetric proportion of $Mg_2Si$, other precipitations in the matrix alloy and also on the charging temperature and charging temperature range. These data can each also be experimentally determined for the respective application.

Another influencing factor is the development of the $Mg_2Si$ precipitations. Conventionally they are encountered as so-called "Chinese script" precipitations, i.e. as acicular precipitations which with respect to their shape are reminiscent of Chinese characters. By adding alloying elements such as for example Ca however primary polygonal precipitations form which behave like particle reinforcements. Moreover the two types of precipitations also act on mechanical and physical properties.

In the production of a semi-finished article from the metal-matrix composite materials as claimed in the invention, the parameters selected in further processing have a decisive effect on the property profile. If forming for example by extrusion takes place, the alignment of planes of the Mg crystallites parallel to the extrusion direction leads to anisotropy. The order of magnitude of the anisotropy is dependent on various factors, especially on the deformation ratio, the temperature in the tool, preheating, heat management after pressing and thus dynamic and static recrystallization. The alloy composition including the influence of impurities is likewise an influencing factor.

Parameters for Production

Temperature management in the production of metal-matrix composite materials using the process as claimed in the invention is directly related to the selected alloy, the shot weight and the tool, especially its component geometry, lug, etc., the geometry of the screw and cylinder in thixomolding, the feed rate and also the injection speed. These parameters must be empirically determined for each component and are also dependent on the design of the machine and its data profile. Likewise the properties also depend on the proportion of solid phase. This influences the mechanical properties of the matrix alloy alone as well as those of the composite material, i.e. the combination of matrix and reinforcement.

With respect to the liquid phase portion the reaction $2Mg+Si \rightarrow Mg_2Si$ means that the alloys build up a high proportion of the liquid phase more rapidly, but at the same time a rising proportion of the solid phase occurs by formation of $Mg_2Si$. The reaction proceeds not only in the cylinder-screw region of the thixomolding machine, but can also proceed after casting in the workpiece. This behavior can be expected mainly in regions with material agglomerations. Under certain circumstances therefore squeezing can be applied more successfully, since part of the matrix alloy is in the molten liquid phase due to the exothermal reaction. Conclusions in this respect can be drawn by studying metallographic sections.

With respect to the matrix alloy, the melt interval plays a major part. For example, take alloy AZ91 with a melting interval in the range from 440 to 600° C. It is known from the literature that for this alloy a high proportion of liquid phase in the range of 95% leads to an improvement of the mechanical properties in the component. At such a liquid phase proportion the melt is considered supercooled. After injection into the tool, in the process as claimed in the invention therefore a high nucleation rate is the consequence, with a simultaneously very large number of nuclei. This leads to development of a very fine structure which has very good properties based on the Hall-Petsch relation. Due to the supercooling of the melt, shrinkage is altogether very low. It is less, the lower the portion of liquid phase. This means at the same time that compared to die casting, fewer internal stresses and thus less warping occur.

In conjunction with the addition of Si an exothermal reaction occurs between Mg and Si when the melt first forms. This means that the heating rate of the machine can be reduced. The order of magnitude for this is dependent on different parameters, especially on the ambient temperature, the thermal insulation of the machine used at the time, and also the thermal conductivities of the different participating components or materials. In the region of heat transfer coefficients at elevated temperatures in a closed system such as a thixomolding machine represents, the relationships are very complex.

The grain size of the granulates is generally not a determining quantity. Depending on the machine and the selected component, a different screw geometry can be chosen. The grain size and the grain shape must be matched to the screw geometry. This is completely independent of the alloy or the composite material. Subsequently the Mg—Si grain size ratio must be matched. This is however generally only feasible for a preciously fixed screw geometry.

The addition of the granulate can take place for example by a simple conveyor device simultaneously or shortly following the granulate feed, both materials are still solid which can be mounted on the machine. Basically a machine of conventional design can be used, as is available on the market for example from the companies Thixomat or Japan Steel Works.

The invention claimed is:

1. A process for producing metal-matrix composite materials comprising at least one portion of magnesium or of a magnesium alloy as a metal component and a $Mg_2Si$ phase component, the process comprising the steps of:

thixomolding a granulate of magnesium or of a magnesium alloy and a granulate of a silicon or of a silicon alloy to produce the $Mg_2Si$ phase with a volumetric content of between 2% and 15% by weight silicon in the $Mg_2Si$ phase as a matrix component dispersed into and thereby forming the metal-matrix composite material with the $Mg_2Si$ phase in the metal-matrix composite being present in an amount from 5% to 40% by volume, wherein the step of thixomolding includes shearing to form an at least partially liquid melt, wherein after adding the granulate of the silicon or of the silicon alloy to the granulate of magnesium or of a magnesium alloy, a heating rate of the thixomolding step is reduced when a melt first forms.

2. The process as claimed in claim 1, wherein the granulate of silicon or of the silicon alloy and the granulate of magnesium or of the magnesium alloy are processed jointly.

3. The process as claimed in claim 2, wherein a size of $Mg_2Si$ phase crystallites which form the metal-matrix composite material or a silicon content of the metal-matrix composite material is determined via the size or amount of the granulate of silicon or of the silicon alloy.

4. The process as claimed in claim 1, wherein in the step of thixomolding includes producing the cast body from the metal-matrix composite materials which is then further processed.

5. The process as claimed in claim 4, wherein the cast body is formed from the metal-matrix composite materials subsequently in at least one process step.

6. The process as claimed in claim 5, wherein the cast body is formed from the metal-matrix composite materials subsequently in at least one of a forging process or an extrusion process.

7. The process as claimed in claim 1, wherein the granulate of magnesium or of the magnesium alloy is one of standard magnesium alloys AZ91, AM50, MR1230D, MR1253M or a magnesium die casting alloy.

8. The process as claimed in claim 2, wherein an amount and a size of $Mg_2Si$ phase crystallites which form the metal-matrix composite material and a silicon content of the metal-matrix composite material are determined via a size and an amount of the granulate of silicon or of the silicon alloy.

9. The process as claimed in claim 2, wherein an amount of $Mg_2Si$ phase crystallites which form the metal-matrix composite material and a silicon content of the metal-matrix composite material are determined via the amount of the granulate of silicon or of the silicon alloy.

* * * * *